US006991490B1

(12) United States Patent
Su

(10) Patent No.: US 6,991,490 B1
(45) Date of Patent: Jan. 31, 2006

(54) ELECTRONIC DEVICE WITH A WATERPROOF CONNECTOR PORT COVER

(75) Inventor: Fei-Ming Su, Chang-Hua Hsien (TW)

(73) Assignee: Universal Scientific Industrial Co., Ltd., (TW)

( * ) Notice: Subject to any disclaimer, the term of this patent is extended or adjusted under 35 U.S.C. 154(b) by 0 days.

(21) Appl. No.: 11/177,282

(22) Filed: Jul. 11, 2005

(51) Int. Cl.
*H01R 13/52* (2006.01)

(52) U.S. Cl. ..... 439/521; 439/142; 439/136

(58) Field of Classification Search ..... 439/135, 439/136, 142, 519, 521
See application file for complete search history.

(56) References Cited

U.S. PATENT DOCUMENTS 4,456,145 A * 6/1984 Frank ..... 439/142
5,358,135 A * 10/1994 Robbins et al. ..... 220/834
6,865,805 B2 * 3/2005 Dispenza et al. ..... 29/848

* cited by examiner

*Primary Examiner*—Tho D. Ta
(74) *Attorney, Agent, or Firm*—Banner & Witcoff, Ltd.

(57) ABSTRACT

An electronic device includes a housing and a connector port cover. The housing is provided with a connector port accessible via an access hole, and an anchor hole disposed proximate to one end of the access hole. The connector port cover is operable for covering and uncovering the connector port, and includes a deformable and water-impervious sealer layer, a rigid pressing layer, and a fastener. The sealer layer has an anchor extension connected to the housing at the anchor hole. The anchor extension is stretchable along the length thereof, and pulls the sealer layer toward said connector port. The pressing layer is connected integrally to the sealer layer. The fastener is operable between tightened and loosened states for retaining releasably the connector port cover at a covering position.

10 Claims, 7 Drawing Sheets

ELECTRONIC DEVICE WITH A WATERPROOF CONNECTOR PORT COVER

BACKGROUND OF THE INVENTION

1. Field of the Invention

The invention relates to an electronic device with a connector port, more particularly to an electronic device with a waterproof connector port cover.

2. Description of the Related Art

As shown in FIG. 1, the housing 11 of a conventional electronic device 1 is provided with a connector port 12, and is formed with an access hole 110 for access to the connector port 12. A connector port cover 13 is employed to protect the connector port 12. The connector port cover 13 is made integrally from rubber, and has an anchor extension 131 connected to the housing 11. Hence, when the connector port cover 13 is removed from the access hole 110 to uncover the connector port 12, the connector port cover 13 is suspended from the housing 11 via the anchor extension 131 to prevent the cover 13 from being misplaced. It is noted that if the dimensions of the connector port cover 13 are too large, too much effort is needed when the connector port cover 13 is inserted into or removed from the access hole 110. On the other hand, if the dimensions of the connector port cover 13 are too small, although the connector port cover 13 can be inserted into or removed from the access hole 110 with relative ease, the connector port cover 13 is unable to establish a watertight seal with the housing 11.

Referring to FIG. 2, another conventional electronic device 2 is shown to similarly include a housing 21 provided with a connector port 211 and formed with an access hole 210 for access to the connector port 211. A connector port cover 22 is employed to cover and uncover the connector port 211, and includes a plastic cover body 221, a rubber gasket 222, a flexible connecting strip 223, a plurality of fasteners 224, and a rotary stop unit 225. The gasket 222 is provided on a periphery of the cover body 221, such as through adhesive bonding or injection molding techniques. The flexible connecting strip 223 is connected to the cover body 221 and the housing 21 by means of the fasteners 224. The stop unit 225 is mounted rotatably on the housing 21, and is operable to a locking position (as indicated by the broken lines in FIG. 2) for retaining the connector port cover 22 at a covering position (not shown). When the connector port cover 22 is at the covering position, the cover body 221 is able to press the gasket 222 toward the connector port 211, thereby causing the gasket 222 to deform in the access hole 210 so as to establish a watertight seal between the connector port cover 22 and the housing 21. When removed from the access hole 210, the connector port cover 22 is suspended from the housing 21 by the connecting strip 223.

However, since the connector port cover 22 includes the connecting strip 223 and the fasteners 224, assembly of the cover 22 is relatively inconvenient to conduct, the size of the cover 22 is relatively large, and higher production costs are incurred for the cover 22. Moreover, since the connection area between the cover body 221 and the gasket 222 is relatively small, the connecting strength between the same is relatively weak, thus resulting in undesired removal of the gasket 222 from the cover body 221 with relative ease during use, which can lead to failure of the waterproofing function of the cover 22.

SUMMARY OF THE INVENTION

Therefore, the object of the present invention is to provide an electronic device with a waterproof connector port cover that can overcome at least one of the aforesaid drawbacks associated with the prior art.

Accordingly, an electronic device of this invention comprises a housing and a connector port cover.

The housing is provided with a connector port, and is formed with an access hole for access to the connector port. The access hole has opposite first and second ends, and is defined by a hole-confining wall. The housing further has an anchor hole disposed proximate to the first end of the access hole.

The connector port cover is operable between a covering position for covering the connector port, and an uncovering position for uncovering the connector port. The connector port cover includes a sealer layer, a pressing layer, and a fastener. The sealer layer is made from a deformable and water-impervious material, has dimensions sufficient for the sealer layer to fill the access hole when the connector port cover is disposed at the covering position, and further has opposite first and second sides to be respectively disposed remote from and proximate to the connector port. The sealer layer further has an anchor extension that extends from the second side of the sealer layer and that has a distal end retained in the anchor hole. The anchor extension is stretchable along the length thereof, and pulls the sealer layer toward the connector port. The pressing layer is made from a rigid material, and is connected integrally to the first side of the sealer layer. The fastener is operable between tightened and loosened states for retaining releasably the connector port cover at the covering position. The fastener applies a pressing force on the pressing layer when in the tightened state for urging the sealer layer toward the connector port such that the sealer layer deforms in the access hole to establish a watertight seal between the hole-confining wall and the sealer layer. The fastener permits operation of the pressing layer to remove the sealer layer from the access hole when in the loosened state so as to dispose the connector port cover at the uncovering position. The anchor extension is stretched and suspends the connector port cover from the housing when the connector port cover is disposed at the uncovering position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Referring to FIGS. 3 to 7, the preferred embodiment of an electronic device according to the present invention is shown to include a housing 3 and a connector port cover 7.

Figure 6:
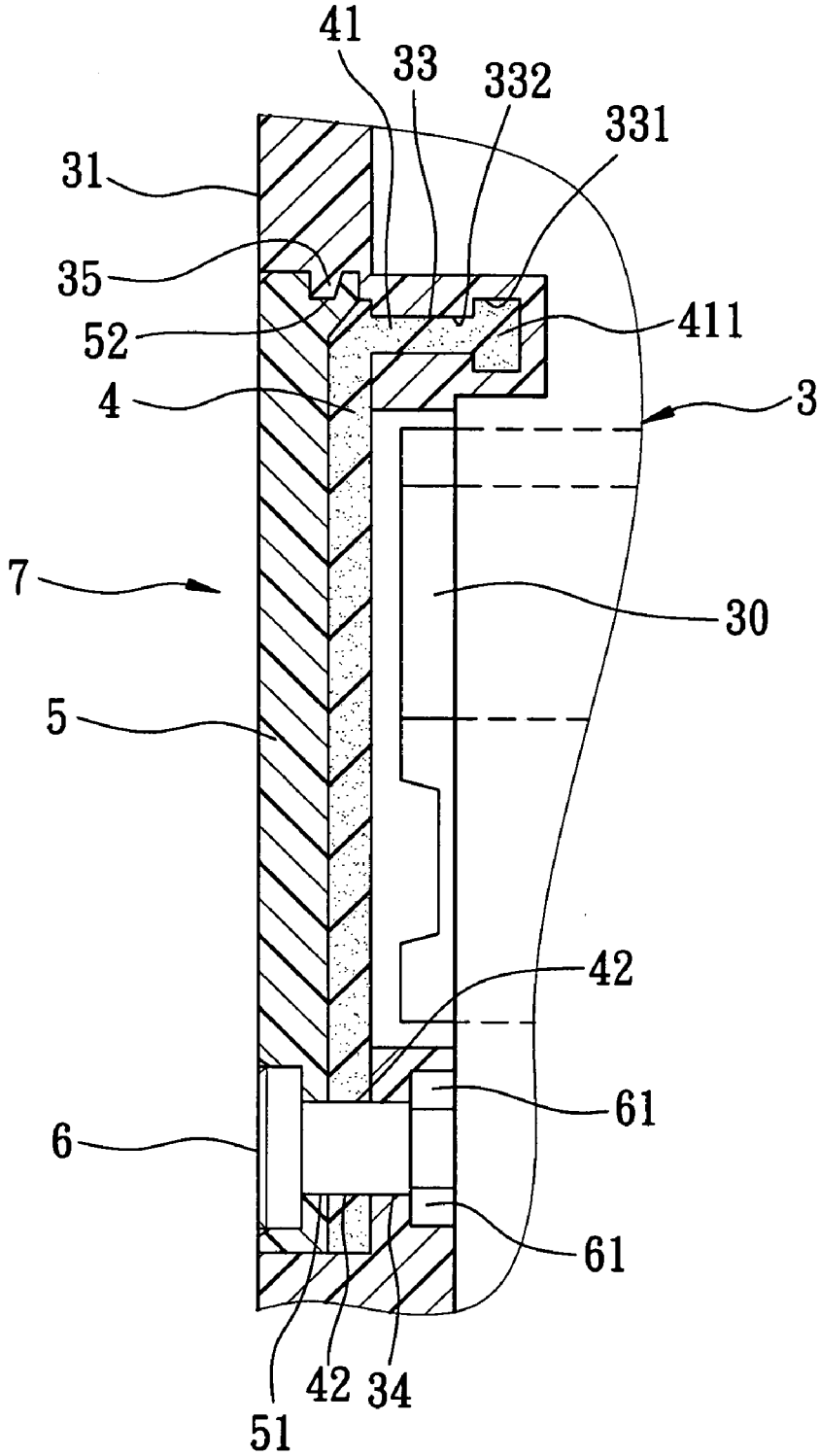
FIG. 6 is a fragmentary schematic sectional view of the preferred embodiment, illustrating the connector port cover at the covering position.
Figure 7:
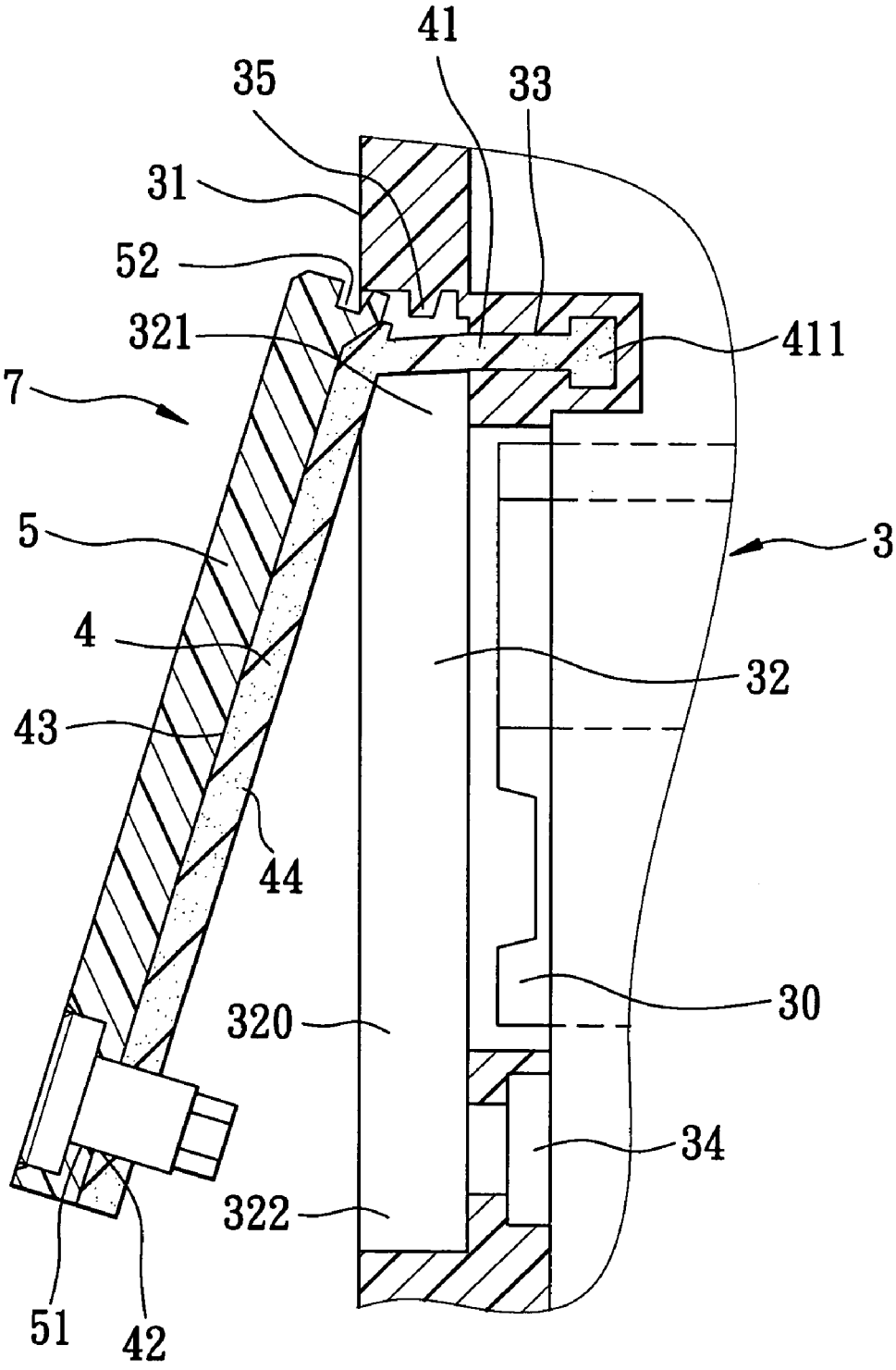
FIG. 7 is a fragmentary schematic sectional view of the preferred embodiment, illustrating the connector port cover at the uncovering position.

The housing 3 is provided with a connector port 30 (see FIGS. 6 and 7), and has a lateral side 31 formed with an access hole 32 for access to the connector port 30. As best shown in FIG. 7, the access hole 32 has opposite first and second ends 321, 322 and is defined by a hole-confining wall 320. The housing 3 further has an anchor hole 33 disposed proximate to the first end 321 of the access hole 32, and a fastener-engaging hole 34 disposed proximate to the second end 322 of the access hole 32.

The connector port cover 7 is operable between a covering position (see FIGS. 5 and 6) for covering the connector port 30, and an uncovering position (see FIGS. 4 and 7) for uncovering the connector port 30. The connector port cover 7 includes a sealer layer 4, a pressing layer 5, and a fastener 6.

The sealer layer 4 is made from a deformable and water-impervious material, such as rubber, has dimensions sufficient for the sealer layer 4 to fill the access hole 32 when the connector port cover 7 is disposed at the covering position, and further has opposite first and second sides 43, 44 (see FIG. 7) to be respectively disposed remote from and proximate to the connector port 30. The sealer layer 4 further has an anchor extension 41 that extends from the second side 44 of the sealer layer 4 and that has a distal end 411 retained in the anchor hole 33. The anchor extension 41 is stretchable along the length thereof, and pulls the sealer layer 4 toward the connector port 30. In this embodiment, the anchor hole 33 of the housing 3 is configured with a larger inner portion 331 and a restricted outer portion 332, as best shown in FIG. 6. The distal end 411 of the anchor extension 41 is received in the inner portion 331 of the anchor hole 33, and is prevented by the outer portion 332 of the anchor hole 33 from escaping from the inner portion 331 of the anchor hole 33. The sealer layer 4 is further formed with a through hole 42 to be aligned with the fastener-engaging hole 34 when the connector port cover 7 is disposed at the covering position.

The pressing layer 5 is made from a rigid material, such as plastic, is connected integrally to the first side 43 of the sealer layer 4, such as through injection molding techniques, and is formed with a through hole 51 that is aligned with the through hole 42 in the sealer layer 4.

The fastener 6 is operable between tightened and loosened states for retaining releasably the connector port cover 7 at the covering position. In this embodiment, the fastener 6 extends rotatably through the through holes 51, 42 in the pressing and sealer layers 5, 4, and is capable of releasable engagement with the housing 3 at the fastener-engaging hole 34. In particular, the fastener 6 has a distal end provided with key projections 61. The fastener-engaging hole 34 has a hole periphery that engages the key projections 61 to prevent the key projections 61 from escaping from the fastener-engaging hole 34 and to result in tight clamping of the connector port cover 7 against the housing 3 when the fastener 6 is at a tightened state, as best shown in FIG. 6, and that permits extension of the key projections 61 through the fastener-engaging hole 34 to result in loose and removable retention of the connector port cover 7 in the access hole 32 when the fastener 6 is at a loosened state. In more detail, when in the tightened state of FIG. 6, the fastener 6 applies a pressing force on the pressing layer 5 for urging the sealer layer 4 toward the connector port 30 such that the sealer layer 4 deforms in the access hole 32 to establish a watertight seal between the hole-confining wall 320 and the sealer layer 4. When in the loosened state, the fastener 6 permits operation of the pressing layer 5 to remove the sealer layer 4 from the access hole 32 so as to dispose the connector port cover 7 at the uncovering position, as best shown in FIG. 7. It is noted that the anchor extension 41 is stretched and suspends the connector port cover 7 from the housing 3 when the connector port cover 7 is disposed at the uncovering position.

In this embodiment, a complementary pair of engaging units are provided respectively on the hole-confining wall 320 of the access hole 32 and on the pressing layer 5, and engage each other when the connector port cover 7 is disposed at the covering position. In this embodiment, the engaging units include a tongue 35 projecting from the hole-confining wall 320 at the first end 321 of the access hole 32 in a direction toward the second end 322 of the access hole 32, and a groove 52 formed in the pressing layer 5 to engage the tongue 35 when the connector port cover 7 is disposed at the covering position.

Figure 1:
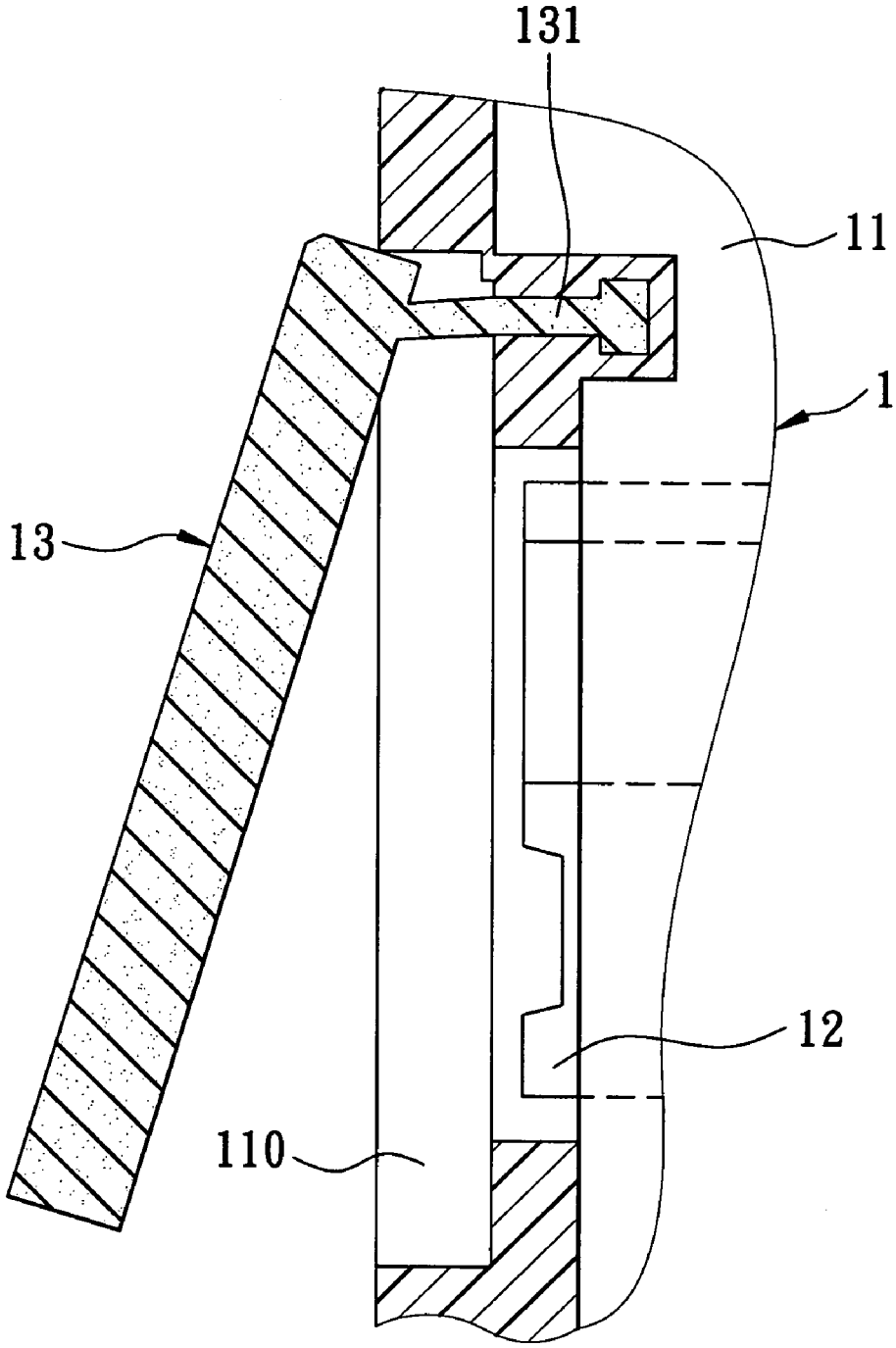
FIG. 1 PRIOR ART
FIG. 1 is a fragmentary schematic sectional view of an electronic device with a conventional connector port cover.
Figure 2:
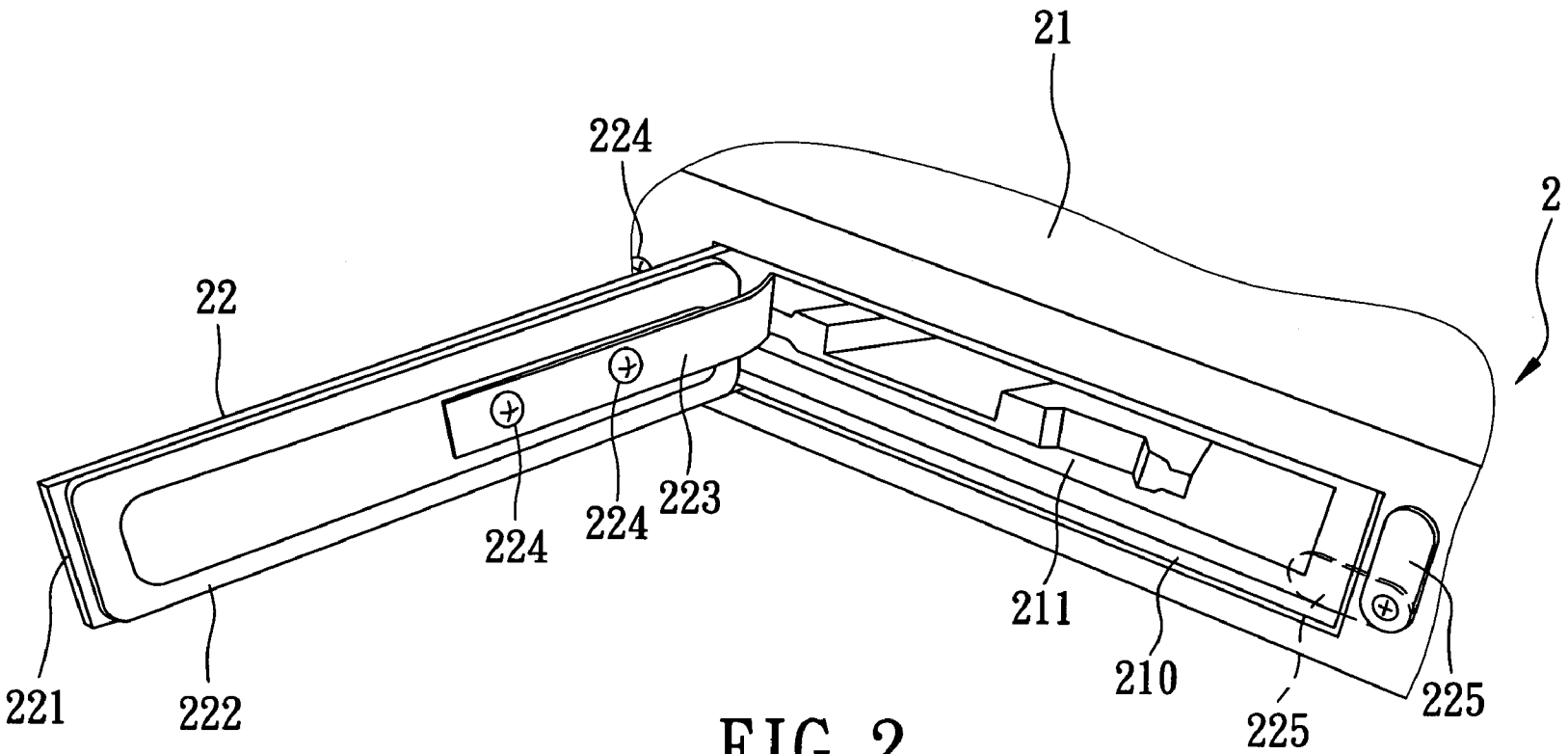
FIG. 2 PRIOR ART
FIG. 2 is a fragmentary perspective view of an electronic device with another conventional connector port cover.
Figure 3:
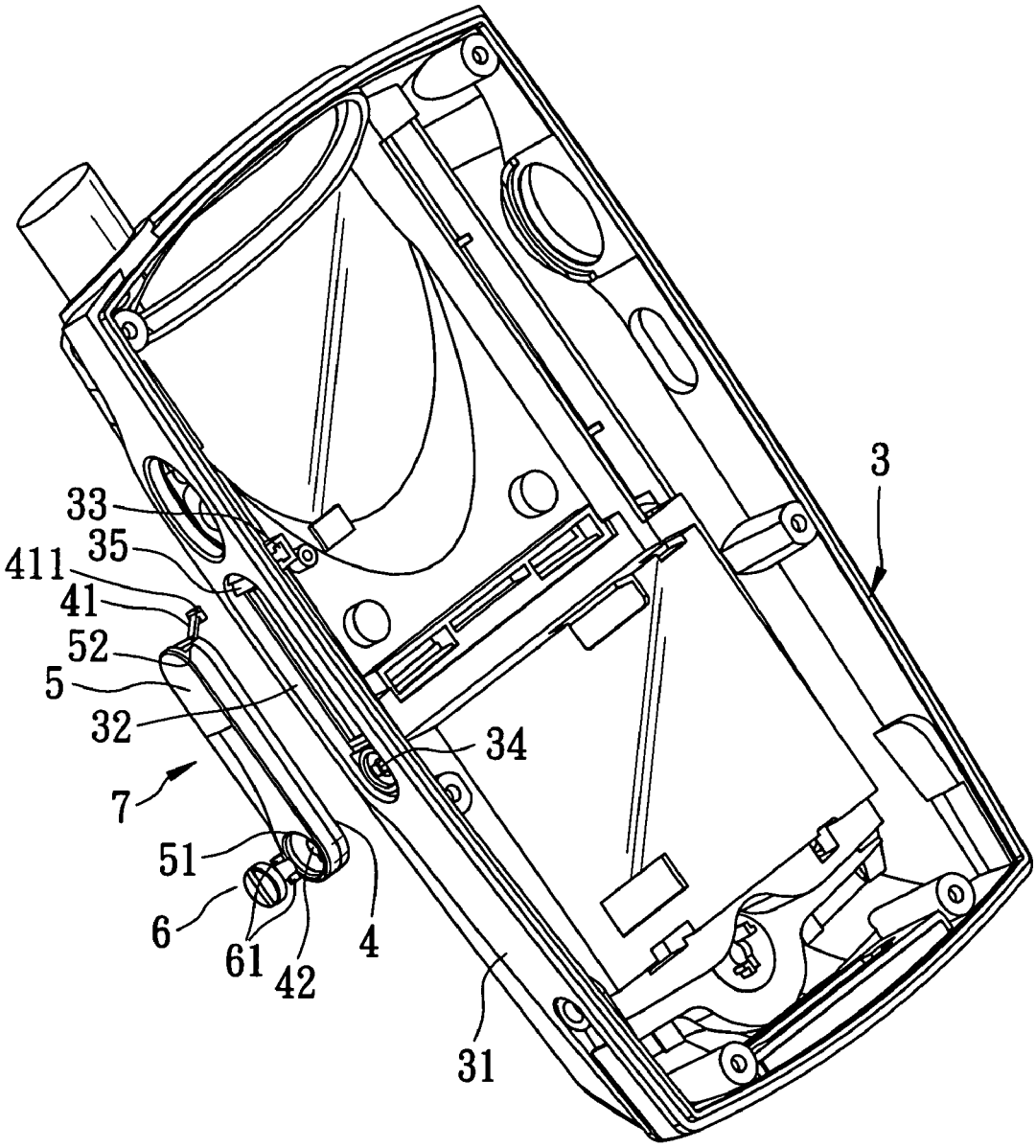
FIG. 3 is an exploded fragmentary perspective view of the preferred embodiment of an electronic device with a waterproof connector port cover according to the present invention.
Figure 4:
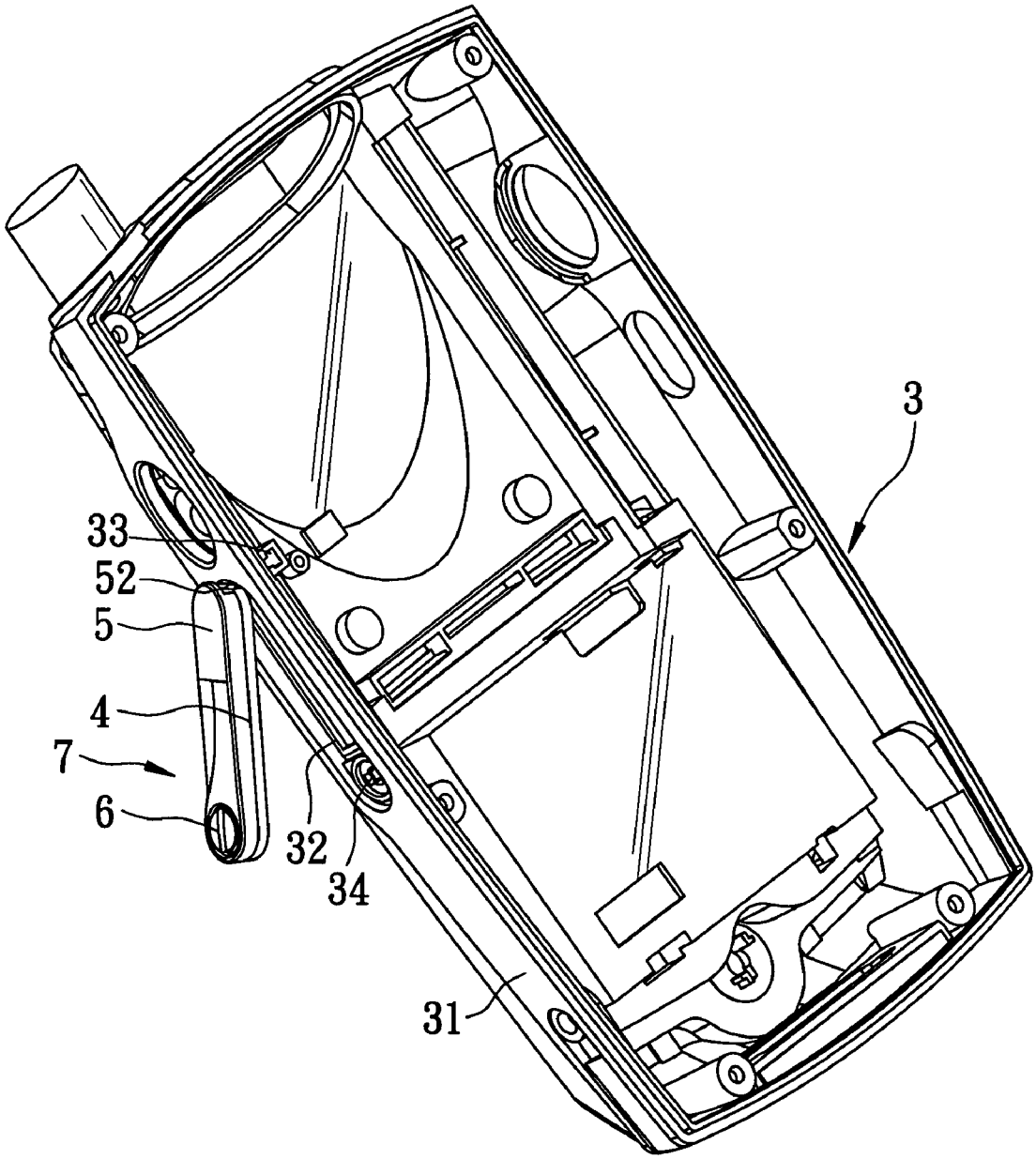
FIG. 4 is a fragmentary perspective view of the preferred embodiment to illustrate the connector port cover at an uncovering position.
Figure 5:
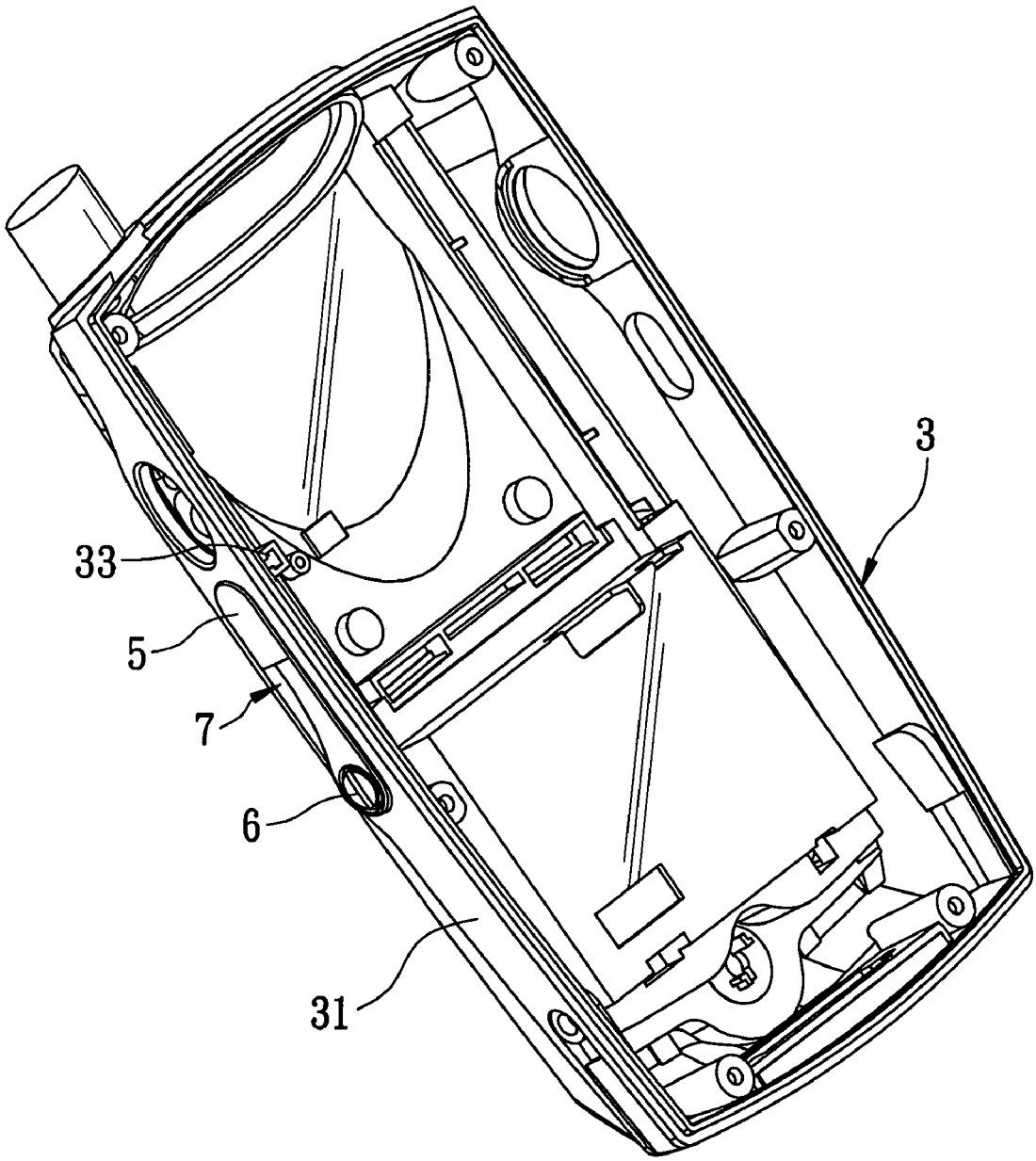
FIG. 5 is a fragmentary perspective view of the preferred embodiment to illustrate the connector port cover at a covering position.

Referring to FIGS. 4, 5 and 6, when it is desired to cover the connector port 30, the connector port cover 7 is operated to engage the tongue 35 with the groove 52, and to permit extension of the fastener 6 through the fastener-engaging hole 34. The fastener 6 is then operated from the loosened state to the tightened state such that the sealer layer 4 deforms in the access hole 32 to establish a watertight seal between the hole-confining wall 320 and the sealer layer 4 in the manner described hereinabove.

Referring to FIGS. 4, 5 and 7, when it is desired to uncover the connector port 30, the fastener 6 is operated from the tightened state to the loosened state, and the pressing layer 5 is operated to disengage the tongue 35 from the groove 52, and to remove the sealer layer 4 from the access hole 32. At this time, the anchor extension 41 is stretched and suspends the connector port cover 7 from the housing 3.

It has thus been shown that the connector port cover 7 can provide a waterproofing function for the electronic device of this invention. In addition, the large connection area between the pressing layer 5 and the sealer layer 4 results in enhanced connection strength between the same to avoid undesired removal of the sealer layer 4 from the pressing layer 5. Moreover, since the anchor extension 41 of the sealer layer 4 is used to connect the connector port cover 7 to the housing 3, assembly of the cover 7 to the housing 3 can be conducted with relative ease, and production costs for the connector port cover 7 can be reduced in view of the relatively simple configuration of the same.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An electronic device, comprising:

a housing provided with a connector port and formed with an access hole for access to said connector port, said access hole having opposite first and second ends and being defined by a hole-confining wall, said housing further having an anchor hole disposed proximate to said first end of said access hole; and a connector port cover operable between a covering position for covering said connector port, and an uncovering position for uncovering said connector port, said connector port cover including a sealer layer made from a deformable and water-impervious material, having dimensions sufficient for said sealer layer to fill said access hole when said connector port cover is disposed at the covering position, and further having opposite first and second sides to be respectively disposed remote from and proximate to said connector port, said sealer layer further having an anchor extension that extends from said second side of said sealer layer and that has a distal end retained in said anchor hole, and a pressing layer made from a rigid material and connected integrally to said first side of said sealer layer.

2. The electronic device as claimed in claim 1, wherein said sealer layer is made from rubber, and said pressing layer is made from plastic.

3. The electronic device as claimed in claim 1, wherein said anchor hole of said housing has a larger inner portion and a restricted outer portion, said distal end of said anchor extension being received in said inner portion of said anchor hole and being prevented by said outer portion of said anchor hole from escaping from said inner portion of said anchor hole.

4. The electronic device as claimed in claim 1, wherein said connector port cover further includes a fastener operable between tightened and loosened states for retaining releasably said connector port cover at the covering position, said fastener applying a pressing force on said pressing layer when in the tightened state for urging said sealer layer toward said connector port such that said sealer layer deforms in said access hole to establish a water-tight seal between said hole-confining wall and said sealer layer, said fastener permitting operation of said pressing layer to remove said sealer layer from said access hole when in the loosened state so as to dispose said connector port cover at the uncovering position.

5. The electronic device as claimed in claim 4, wherein said housing further has a fastener-engaging hole disposed proximate to said second end of said access hole, said fastener extending through said pressing layer and said sealer layer and being capable of releasable engagement with said housing at said fastener-engaging hole.

6. The electronic device as claimed in claim 5, wherein said fastener extends rotatably through said pressing layer and said sealer layer and has a distal end provided with a key projection, said fastener-engaging hole having a hole periphery that engages said key projection to prevent said key projection from escaping from said fastener-engaging hole and to result in tight clamping of said connector port cover against said housing when said fastener is at the tightened state, and that permits extension of said key projection through said fastener-engaging hole to result in loose and removable retention of said connector port cover in said access hole when said fastener is at the loosened state.

7. The electronic device as claimed in claim 1, wherein said anchor extension is stretchable along the length thereof and pulls said sealer layer toward said connector port.

8. The electronic device as claimed in claim 7, wherein said anchor extension is stretched and suspends said connector port cover from said housing when said connector port cover is disposed at the uncovering position.

9. The electronic device as claimed in claim 1, further comprising a complementary pair of engaging units that are provided respectively on said hole-confining wall of said access hole and on said pressing layer and that engage each other when said connector port cover is disposed at the covering position.

10. The electronic device as claimed in claim 9, wherein said engaging units include:

a tongue projecting from said hole-confining wall at said first end of said access hole in a direction toward said second end of said access hole; and a groove formed in said pressing layer to engage said tongue when said connector port cover is disposed at the covering position.

* * * * *